United States Patent [19]

Gustavsson

[11] Patent Number: 4,505,493

[45] Date of Patent: Mar. 19, 1985

[54] SLALOM SKI BINDING

[75] Inventor: Jack G. Gustavsson, Katrineholm, Sweden

[73] Assignee: Aktiebolaget S K F, Gothenburg, Sweden

[21] Appl. No.: 271,801

[22] PCT Filed: May 22, 1979

[86] PCT No.: PCT/SE79/00116

§ 371 Date: Feb. 19, 1980

§ 102(e) Date: Jan. 30, 1980

[87] PCT Pub. No.: WO80/00063

PCT Pub. Date: Jan. 24, 1980

Related U.S. Application Data

[63] Continuation-in-part of Ser. No. 189,922, Jan. 30, 1980, abandoned.

[30] Foreign Application Priority Data

| | | | |
|---|---|---|---|
| Jun. 19, 1978 | [SE] | Sweden | 7807010 |
| Jun. 10, 1980 | [SE] | Sweden | 8004325 |
| Jun. 10, 1980 | [SE] | Sweden | 8004326 |
| Apr. 16, 1981 | [SE] | Sweden | 8102476 |

[51] Int. Cl.[3] ..... N63C 9/08

[52] U.S. Cl. ..... 280/617; 280/624; 280/636

[58] Field of Search ..... 280/613, 614, 617, 618, 280/624, 625, 626, 636, 633, 627, 620, 630, 607

[56] References Cited

U.S. PATENT DOCUMENTS

| | | | |
|---|---|---|---|
| 3,797,844 | 3/1974 | Smolka et al. | 280/607 |
| 3,887,205 | 6/1975 | Edmund | 280/624 |
| 3,905,613 | 9/1975 | Romeo | 280/624 |
| 3,931,980 | 1/1976 | Marker | 280/613 |
| 3,936,064 | 2/1976 | D'Alessio | 280/618 |
| 4,278,269 | 7/1981 | Beyl | 280/613 |

FOREIGN PATENT DOCUMENTS

| | | | |
|---|---|---|---|
| 1428876 | 12/1968 | Fed. Rep. of Germany . | |
| 1428894 | 4/1969 | Fed. Rep. of Germany . | |
| 2200056 | 1/1973 | Fed. Rep. of Germany . | |
| 2429811 | 3/1975 | Fed. Rep. of Germany . | |
| 2452256 | 5/1975 | Fed. Rep. of Germany . | |
| 2417892 | 10/1975 | Fed. Rep. of Germany | 280/613 |
| 2421602 | 11/1975 | Fed. Rep. of Germany | 280/614 |
| 7803397 | 9/1978 | Sweden . | |

OTHER PUBLICATIONS

WO80/00063 published Jan. 24, 1980, Gustavsson.

*Primary Examiner*—David M. Mitchell
*Attorney, Agent, or Firm*—McCormick, Paulding & Huber

[57] ABSTRACT

In one version a safety binding (1) for downhill skiing comprises a toe connection means (5, 24) and a heel connection means (6) for co-operation with corresponding parts of a ski boot (3'), in which the toe connection means comprising a rotatable roller (5) having a support web portion (16) and from the said web portion an upwardly diverging conical portion (17), which roller (5) and its shaft (12) are spring biased and movable in the longitudinal direction of the ski (2). The heel connection means (6) comprises an U-formed clamp (26, 27) which is rotatably mounted about a vertical fixed pin (25) of the binding and which is formed with two parallel upright lock clamps (27) having recesses facing the front part of the binding and co-operating with side rollers (33) of the boot. The toe connection means (5, 24) and the heel connection means is fixed to the ski as shown in one version, or movably mounted thereto as shown in version two.

15 Claims, 11 Drawing Figures

FIG. 1
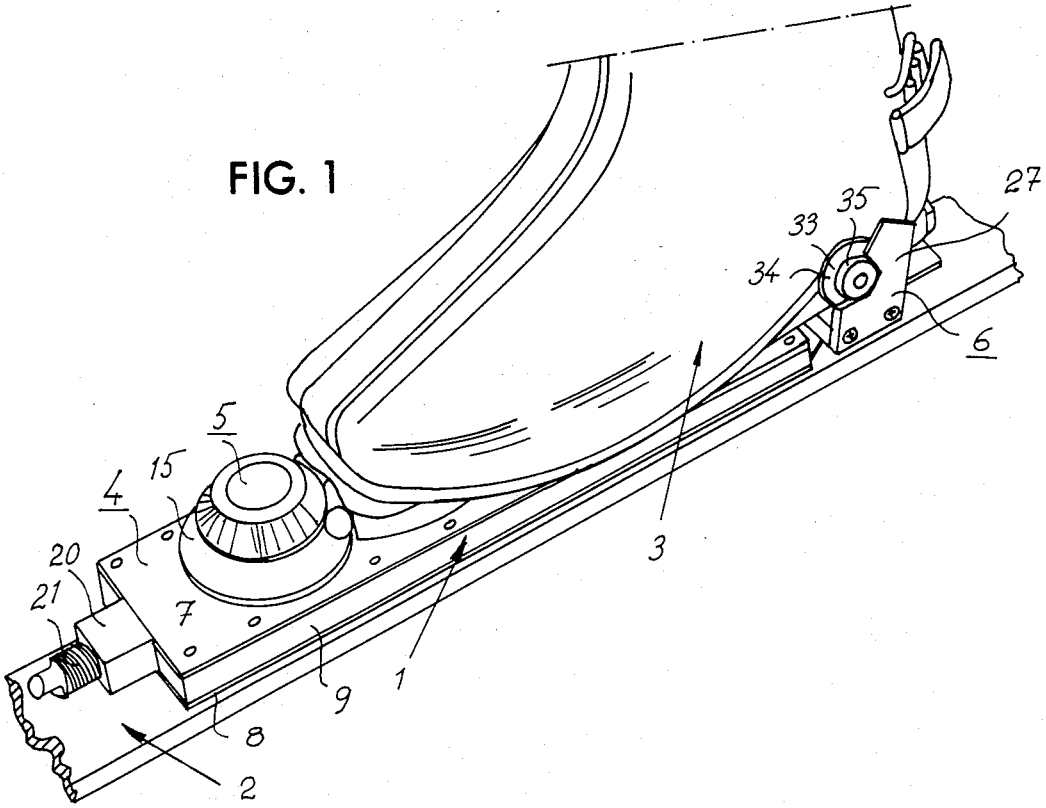
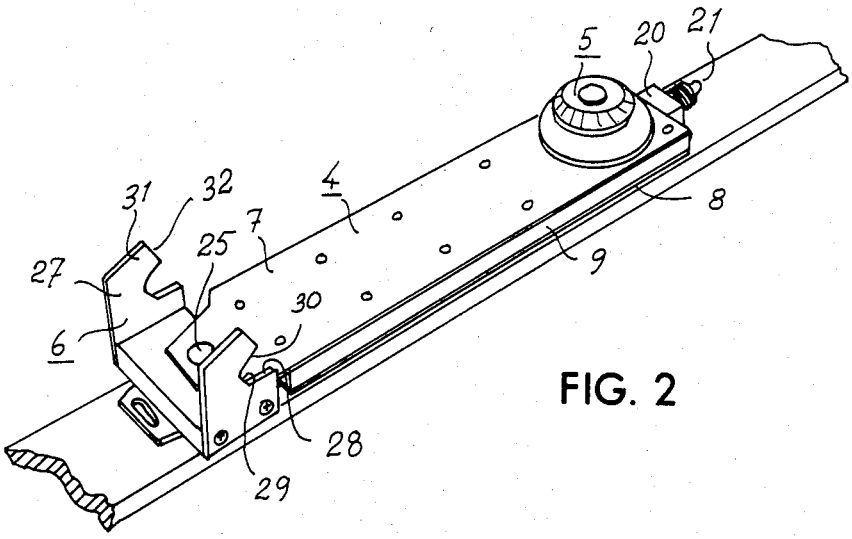
FIG. 2

SLALOM SKI BINDING

CROSS REFERENCE TO RELATED APPLICATIONS

This application is a continuation-in-part of Ser. No. 189,922 filed Jan. 30, 1980 and now abandoned which was based on PCT/SE 7900116 filed in Sweden May 22, 1979 and based in turn on an earlier Swedish patent application No. 78/07010-9 filed June 19, 1978. Priority is claimed to all of the above, and to other Swedish applications. Certified copies of the latter are to be found in this application file. Certified copies of the above enumerated priority documents are to be found in the file identified by the U.S. Patent and Trademark Office as Ser. No. 189,922 and now abandoned in favor of this application.

The present invention generally relates to ski bindings, and more particularly the invention is directed to a type of slalom binding, so called release binding, which is formed with a toe fastening means and a heel fastening means which co-operate with the slalom boot in such a way, that the binding does not cause a release of the boot at normal skiing but oppositely causes a release of a boot from the binding at a relative force between the slalom boot and the binding exceding a predetermined force. It must be possible to obtain a release either when the boot is subjected to a strong rotating movement in relation to the slalom binding or when the boot is raised from the binding at the heel fastening means or possibly at the toe fastening means.

Ski bindings of this type are well known in the art and the ski binding which is at present most commonly used comprises two separate parts, viz. a toe connection means and a heel connection means. The heel connection means is formed so that it may, by a special actuation, be folded up whereas the toe connection means comprises a bracket which generally can be rotated about a vertical shaft but which by an adjustable spring is kept in a predetermined central position. The slalom boot is clamped into such a binding in that the boot is put down on the binding and the toe cup is moved into a position underneath the bracket at the toe connection means, whereupon the heel connection means is stepped on so as to clamp the heel portion of the boot to the ski or the binding.

It has been found that the friction between the boot and the ski at rotation under load often is too high, so that the binding does not release sufficiently early, and to eliminate the said disadvantage on anti-friction plate has been mounted just behind the toe bracket at a bottom plate which is connected to the toe connection means. In this case it is important that the toe cup bracket is adjusted so that the slalom boot is kept pressed on-to the friction plate and so that the said pressure is such that the binding really releases if the boot is rotated vigorously in relation to the ski. Pressing downwards too strongly or the boot may cause the binding to not release and a too light clamping may cause the binding to release at too low forces. Also the heel connection means must press the boot to the binding with such force that the binding releases when the boot is raised with an exactly predetermined force.

Ski binding of this type are disadvantageous in some respects. Both the toe connection means and the heel connection means must be adjusted very carefully depending on the weight of the skier, the skill of the skier, the condition of the ski path and many other factors.

The adjustment must be made very exactly which is both a time consuming and an accuracy demanding job. It is also very important that the boot is completely clean at the bottom surface both when adjusting the binding and when skiing, since snow, ice, sand or any other material at the bottom surface of the boot cause changes of the release values. Further the friction plate for the toe cup of the boot is worn by time, and the binding frequently must be readjusted. Sinse the binding is formed with two parts there is also a need for great accuracy when mounting the binding on the ski, and both rough adjustment and fine adjustment of the release forces must be made after the binding is mounted on the ski.

In order to eliminate some of the above mentioned disadvantages another type of ski binding has entered the market which is a so called plate binding in which the toe connection means and the heel connection means are mounted in a plate which is releasable and which can in turn be clamped to the ski by means of two fastening means, one for the front part of the plate and one for the rear part of the plate.

Also in such plate ski bindings the release is made by rotating and lifting forces, and at release the entire unit of boot and plate is released whereas on the contrary the fastening means remain on the ski.

Also in this type of ski binding there are two adjustment means for the plate, one for the front part of the plate and one for the rear part thereof. Also in this bindning there is an anti-friction plate provided just behind the toe connection means mounted on the ski, and also in this case snow, ice, sand and other impurities may cause a false rotation release. Also in this case the toe connection means and the heel connection means are separated from each other and also in this case the adjustment must be made by means of two separate adjustment screws. Like in the previously discussed ski binding the tow connection means and the heel connection means move when the ski bows for instance at a pit or a hump, and there is a serious risk that the binding falsely releases at pits or humps of the slope.

Another type of ski binding, in which attempts have been made to eliminate further or other disadvantages comprises a plate, which is screwed to the underside of the boot and which co-operates with two side palls which are screw connected to the ski. Also this binding is sensitive to snow, ice or impurities under the boot or under the plate, impurities may easily enter the clamp mechanism for the side palls, and the side palls must for various reasons be very strongly clamped, and therefore it may be difficult to put on the boot including the attachment plate on the ski binding, especially for children.

Most of the previously known ski bindings also involve the disadvantage that the boot always must enter the binding with the toe part first whereas it may seem natural to many people to clamp the binding with the heel part of the boot being put down first on the ski or the bottom plate. In most of the previous slalom bindings the heel connection means is provided to clamp the boot at the rearmost part thereof, whereas for orthopedical reasons it is considered more suitable to provide the heel connection means so as to form substantially an elongation of the longitudinal direction of the fibula (the lower leg portion). In this case a rotation and a subsequent release follows substantially about the center of the leg rather than some distance behind the said center like in the previously known ski bindings.

The invention therefore relates to solving the problem to provide a safety ski binding for downhill skiing which provides a simple connection of the binding to the ski, provides a simple step-in or treading of the boot into the binding, is formed as an integral unit of toe connection means, heel connection means and intermediate plate, provides a good release depending on side forces, makes a release possible even in the direction upwards of the toe portion, allows a release upwards for the heel portion of the boot, which has one single adjustment means which is common for the entire ski binding, which keeps the boot safely free from play, which may easily be moved to other skis, which is basicly unsensitive to snow, ice, dirt and impurities, in which the boot can very easily be treated after the binding has released, which is completely unsensitive to bows of the ski at pits or humps etc., and which is completely maintenance-free.

Thus the invention relates to a safety ski binding for downhill skiing comprising a toe connection means and a heel connection means for co-operation with corresponding parts of a ski boot, and the invention is generally characterized in that the toe connection means comprises a convexly formed support or rotatable roller which is spring biased in the direction towards the heel connection means and which comprises a cylindrical shaft and upwardly diverging conical portion.

In one version of the invention the toe connection means and the heel connection means are interconnected by means of a binding plate, and the entire binding provides an integral unit which, as a unit, can be mounted directly on the ski. The conical portion of the toe connection roller may be a biconic roller which in addition to a release both in the transversal direction and in the direction upwards of the toe part of the boot at super strong load also makes it possible to tread the boot into the binding by pressing the boot straight downwards by contacting the upper cone of the biconic roller. The heel connection means comprises a pair of clamps having grooves engaging the heel portion of the boot and which co-operate with rollers provided in the boot substantially on line with the fibula of the skier. The heel connection clamp is preferably rotatably mounted in the intermediate plate and it is suitably formed so that the boot can be mounted also in that the heel portion of the boot is pressed straightly downwards. In a particular embodiment of the invention there is an essential characteristics in that the boot does not directly contact the binding plate but there is a small space between the binding plate and the boot what makes the ski binding faily unsensitive to snow, ice and impurities at the underside of the boot.

In the presently preferred version of the invention a base plate carries a toe connection means at one end for a ski boot toe and at the opposite end a heel connection means for the ski boot heel. The toe connection means comprises a convexly formed support or roller which co-operates with a concavely formed portion at the toe of the ski boot, and the heel connection means comprises a rotatably mounted U-formed bracket having clamp grooves co-operating with side rollers or any other connection means at or adjacent the heel of the ski boot. The toe roller is spring biased in the direction towards the heel connection means and it is formed conical so that the ski boot can be tread down while sliding along the conical portion of the roller. The roller is formed with a neck which is undercut from the conical portion of the roller and in which the concavely formed toe portion of the boot engages in a locking engagement. The release of the ski binding generally follows by rotating the ski boot about the heel connection means so that the concave toe portion is twisted of the toe roller. Release also may follow by a strong actuation upwards at the toe or at the heel.

A ski binding of this type is known from the Swedish patent application Ser. No. 78 07010-9 filed under Ser. No. 189,922 in the United States and having Swedish publication No. 409 176. The said previously known ski binding comprises as mentioned above a base plate on which both a toe connection roller and a heel connection bracket are mounted, and the base plate together with the toe connection means and the heel connection means is screwed to a ski at or adjacent the prompt and the rear ends respectively of the base plate. By such mounting of the ski binding the ski becomes more or less butt mounted between the connection points of the binding so that the ski can not bow upwards or downwards respectively between the said connection points. In some cases this may be disadvantageous, especially when race skiing whereby it is a wish to have the ski follow the formations of the hill as carefully as possible.

The object of the invention therefore is the problem to provide a safety ski binding of the above mentioned type which is formed and mounted at the ski so that the ski may bow upwards or downwards between the connection points to the binding. According to the invention this object is fulfilled in that the base plate is fixed mounted at the ski only at one end whereas the opposite end of the binding is mounted at the ski over a connection point which is movable in the longitudinal direction of the ski. Preferably the fixed connection point is provided at the heel portion of a base plate whereas the movable connection point is provided by a slid which is screwed to the ski in front of the base plate and which co-operates with a pin projecting from the base plate andd which is slidable and slightly rotatable in a guide of the said slide means.

By mounting the binding as mentioned above the ski has a possibility of moving while bowing upwards or downwards in relation to the base plate of the ski binding between the connection points and it may even rotate slightly in relation to the base plate. As a consequence the ski may satisfactorily follow the formations of the hill and an improved hill keeping property of the ski is obtained, there is a reduced tendency of the ski to cut through the snow and thereby an increased speed during skiing may be obtained. The slidable connection at the front end or toe end of the binding, however, gives a displacement forwardly and rearwardly at the front connection point as compared with the above menitoned previously known ski binding what from different viewpoints may be disadvantageous in spite of the fact that such mounting of the ski binding is still better than the fixed mounting of the binding as previously known. It may also involve certain problems that the ski binding at the front end moves slightly in relation to the ski while the ski bows upwards or downwards underneath the ski.

According to a further embodiment of the invention it is therefore suggested that the ski binding is formed and mounted at the ski so that a displacable connection is obtained at least at or adjacent the rear end of the binding. Thereby the above mentioned problems with the displacable front connection means is solved and a very good effect is obtained especially for race ski bindings.

The displacable connection between the binding and the ski may alternatively be located at some place underneath the base plate between the toe or heel portions thereof while the fixed connection point is provided at the rear end of the binding. In relation to the above mentioned apparatus having a displacable connection with a forwardly projecting pin a still improved ground keeping property is obtained in that the displacable connection points is located closer to a line corresponding to the gravity center line of the body of the skier.

It is also possible to provide a displacable connection both at the rear end and at the front end of the binding. It is essential to the invention that there is at least one dispacable connection between the binding and the ski and preferably at the said displacable point of connection is located a substantial distance rearwardly of the toe portion of the binding and of the ski boot.

Further characteristics and advantageous of the invention will be evident from the following detailed specification in which reference will be made to the accompanying drawings. It should, however, be pointed out that the described and shown embodiments of the invention are only illustrative examples which do not restrict the invention and that many different variations and modifications may be presented within the scope of the appended claims.

In the drawings

FIG. 1 diagrammatically and in a perspective view nearly from in front illustrates a ski binding according to the invention and the belonging boot;

FIG. 2 diagrammatically and in a perspective view from behind shows the same ski binding but without the boot;

FIG. 3 is a vertical cross section centrally through an embodiment of the ski binding and FIG. 4 illustrates the same ski binding from the above and in part diagrammatically;

FIG. 1A diagrammatically and in a perspective view shows a safety ski binding of the invention;

Figure 1A:
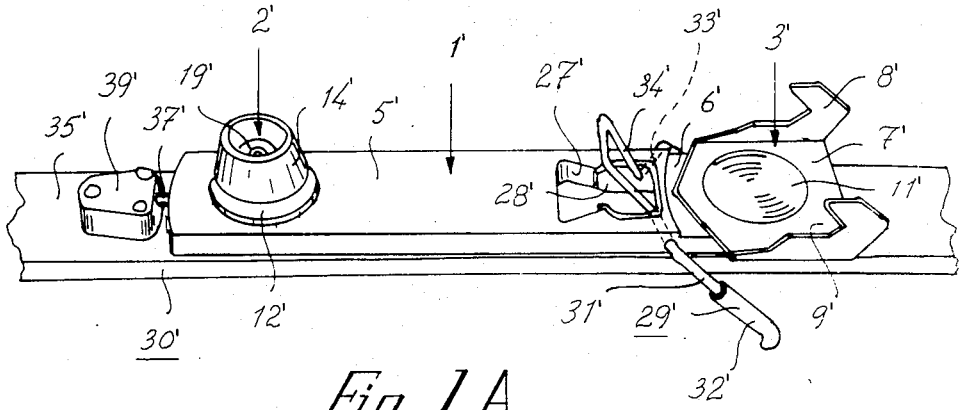
Figure 2A:
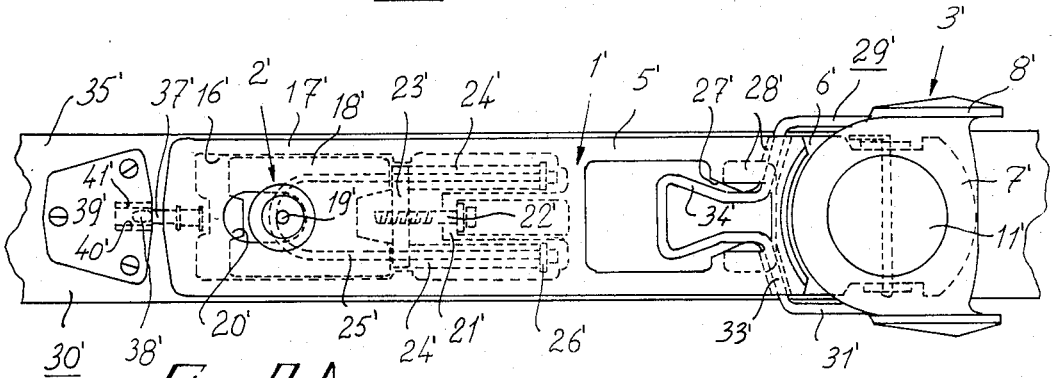
FIG. 2A is a top view of the ski binding according to FIG. 1A showing the essential inner parts thereof with dotted lines.

With reference to FIGS. 1–4 of the drawings there is shown a safety ski binding 1 for downhill skiing which is formed as an integral unit and adapted to be mounted on a ski 2 and for use together with a ski boot 3 having special fittings adapted to the binding. The binding generally comprises a base plate 4 which at its front end carries a toe connection means in a form of a conical or biconical roller 5 and which at the rear end carries a heel connection means 6 for the boot.

Figure 3A:
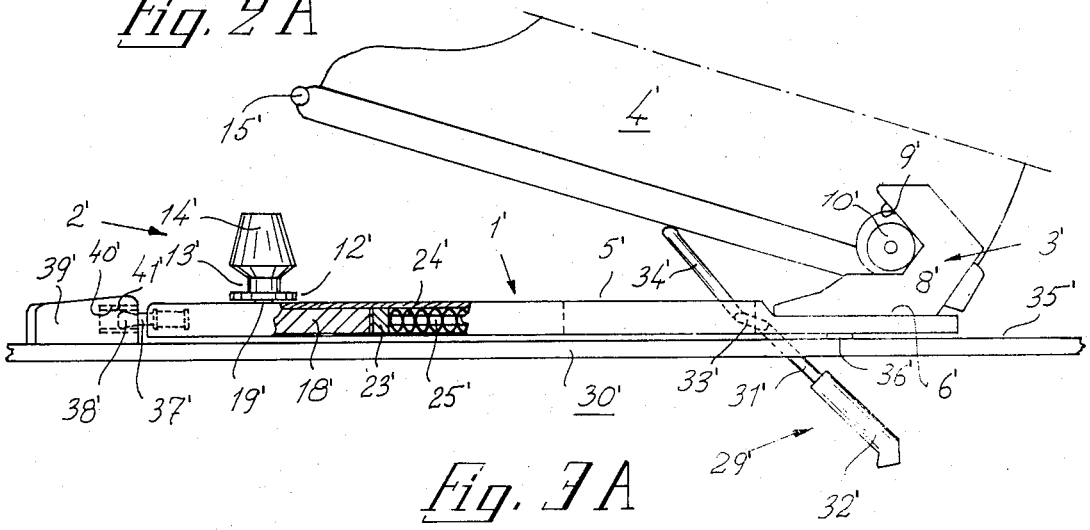
FIG. 3A is a side view of the ski binding of FIG. 2A showing for the sake of clearness some parts broken.
Figure 3:
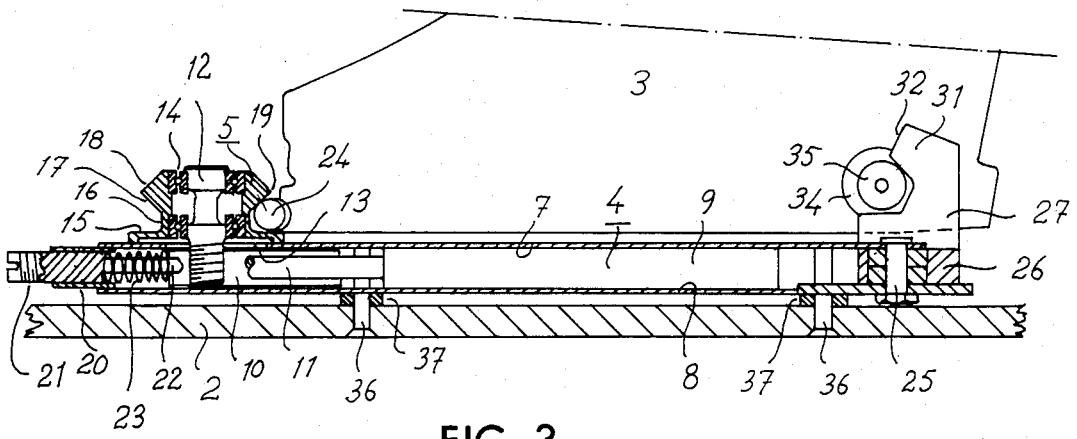

As best illustrated in FIG. 3 the base plate 4 is formed as a box which is at least partly hollow and which comprises a top plate 7 a bottom plate 8 and sides 9. The plates 7 and 8 may be of metal, for instance aluminum, which is suitably treated to act repellant to snow, ice and dirt etc. At the front end the base plate 4 carries the toe connection means 5 for the boot 3 and at the rear end the base plate carries the heel connection means 6 for the boot 3.

The toe connection means includes a slide 10 which is slidable in the longitudinal direction of the ski binding inside the base plate 4 and it is guided by two longitudinally extending guide bars 11. In the slide 10 a pin screw 12 is mounted which extends up through a longitudinal slot 13 of the top plate 7. The upper portion of the pin screw 12 carries the toe connection roller 5 on ball bearings 14 so that the roller by the least possible friction can rotate about the pin screw 12. The roller 5 is formed with a guiding base disc 15 contacting or provided adjacent the top plate 7, and from the base disc 15 a short web portion extends upwards which runs into an upwardly diverging cone 17. The cone angle can be varied according to the circumstances, but a suitable cone angle may be 45°. From the diverging cone 17 the roller is formed with an upwardly converging second cone 18, so that the roller provides a bicone having a cone angle tip or narrow border surface 19. The cone surface 17 acts to enable a release by rotating the boot 3 upwards from the heel connection means and the cone surface 18 acts to enable a treading of the boot into a binding with the toe moved downwards over the cone surface 18. At the front short end the base plate 24 has a projecting screw support 20 which is fixed connected to the base plate, and through the said screw support a screw 21 extends rearwardly to a shoulder of the slide 10. The portion of the screw 20 facing the slide 10 is tapered at 22, and there is a shoulder between a narrow portion 22 and the wide portion of the screw. On the narrow portion 22 of the screw a number of cup springs 23 are mounted and the said springs are clamped between the shoulder of the screw 21 and the slide 10. By adjusting the screw 21 it is consequently possible to provide a stronger lighter clamp force for the boot. By further reducing or increasing the number of cup springs the binding can easily be adapted to different sizes of boots or to boots of different types.

For co-operation with the roller 5 the boot is provided with a connection bar 24 at the toe cup thereof. The connection bar 24 is screwed or in any other way stably mounted on the boot and it is bow formed or angularly formed. The angle and the length of the connection bar 24 is adapted to the intended effect. A short connection bar or a connection bar having a wide opening angle gives a quicker release than a long connection bar or a bar having a more narrow opening angle. By the bow form or angle form the boot gets a possibility to rotate some distance in relation to the roller 5 while the said roller 5 is pressed forwards against the action of the cup springs 23, and if the torque does not exceed the maximum torque for release the spring biassed roller 5 presses the boot back to its initial position as soon as the torque or the rotation force ceases. Since the binding is completely symmetrical the boot may rotate in both directs with the same effect. At the rear end of the binding the top plate 7 and the bottom plate 8 projects some distance outside the base plate 4 and between the said projecting portions of the plates 7 and 8 the heel connection means 6 is rotatably mounted about a vertical pin 25. The heel connection means or the heel clamp is formed by a bottom plate 26 which is rotable about the vertical pin 25 and which at each side of the binding carries an upwardly projecting lock clamp 27. The lock clamps 27 can be screwed or mounted in any other way at the bottom plate 26 and at the front edges each lock clamp 27 is formed with a recess preferably in the form of three straight edges of which the bottom edge 28 extends parallelly to the base plate 4, the rear end 29 upwards at some angle rearwardly from the bottom edge 28 and the upper edge 30 extends forwards-upwards at some angle to the horisontal plane. Above the recesses the lock clamps provide a forwardly directed ear 31 the front edge 32 of which is directed upwards-rearwards at some angle to the horisontal plane. The angles of the upper edge 30 and the front edge 32 are determined according to the circumstances. The purpose of the upper edge 30 is to make a release possible by lifting the boot upwards with a force exceeding a predetermined maximum clamp force, and the purpose of the front edge 32 is to enable a treading of the boot straight downwards into the binding.

For co-operation with the lock clamps 27 the boot is provided with a roller 33 on both sides thereof. The roller 33 is formed with a vertical or slightly conical flange 34 and a horizontal cylindrical portion 35. The purpose of the flange 34 is to provide a guiding of the boot into exact position against the lock clamps 27, and the purpose of the horisontal cylindric portion 35 is to provide a locking of the boot in the lock clamps. Therefore the dimension of the horizontal portion 35 of the rollers 33 is adapted to the dimensions of the recess 28-30. It should be observed that the toe and heel clamps and the corresponding parts of the boot are preferably formed so that the boot is not in direct contact with the top plate 7 but a small space is present between the boot and the top plate to permit a slight amount of snow, ice or dirt on the boot without causing problems.

The binding can be mounted in any suitable way on the ski and in FIG. 3 is shown how the binding is mounted by means of screws 36 acting from underneath the ski. Preferably the rear portion of the binding is connected by means of two parallell screws whereas the front portion is connected by means of one single screw. In order to eliminate the risk of unintentional release in case of pits humps or similar the binding can be mounted on a slight distance above the upper surface of the ski, and for this purpose a space washer 37 is provided between the ski and the binding which permits the ski to bow without inflicting the binding.

In the conventional way the binding can be provided with recesses for a catch strap for instance in the form of a slot 38 provided in the portion of the bottom plate 8 projecting rearwardly or the binding can be provided with a stop means of a type known per se which releases and stops the ski as soon as the boot is removed upwards from the binding.

The binding according to the invention may as a complete unit be manufactured and adjusted in a factory together with a boot and there is no need for a complicated mounting or adjusting. The only thing which possibly remains is the adjustment of the release force depending on special demands from the skier and this is made by one single adjustment means, viz. the screw 21. The boot can very simply be treaded into the binding either in that the toe connection bar 24 is introduced in the toe roller 5 whereupon the boot is treaded downwards with the heel portion, whereby the cylinder part 35 of the boot roller 33 slides along the front edge 32 of the lock clamp 27 and snaps into the recess 28-30, or in that the boot is mounted in the opposite way, viz. so that the heel portion is firstly moved into the lock clamps 27, whereupon the toe portion of the boot is treaded down over the biconical roller 5. Since there is no coonnection between the underside of the boot and the binding both ways of treading the boot into the binding are easy, and in both ways the double cone roller is moved somewhat against the action of the cup springs 23 until the toe or heel portion of the boot has snapped into its respective connection means.

The ski binding according to the invention as illustrated in FIGS. 1A–3A generally comprises a base plate 1' which carries both a toe connection means 2' and a heel connection means 3' for a ski boot 4'. The base plate 1' is formed as a box having a substantially even upper surface 5' encasing some vital portions for the actuation of the toe connection means 2'. The base plate may be solid or hollow made of metal, plastic or any other suitable material and having recesses for the inner movable parts. Adjacent the rear end the base plate is formed with a stepped down portion 6' for mounting of a heel connection means 3'. The upper surface of the heel connection means extends substantially on level with the upper surface 5' of the base plate.

The heel connection means 3' is made as a substantially U-formed bracket having a bottom and from the bottom upwardly projecting side plates 8' formed with an obliquely upwards-forwards directing slot 9' in which side connection means like side rollers 10' at the heel of the ski boot 4' are adapted to engage. The slot 9' has a horizontal bottom edge but an obliquely upwards directed upper edge so that a release may follow in that the ski boot is pulled upwards from the heel. The heel connection means 3' is mounted freely rotatable about a central pin 11' mounted in the base plate 1'.

In the embodiment of FIGS. 1A–3A the toe connection means is a rotatable roller 2' having a lower horizontal cylindrical disc 12, from the said disc 12' a projecting narrow neck 13' which is widened to an upwardly bevelled cone 14' against which a concavely formed portion 15' of the ski boot is adapted to slide while treading the boot into the binding.

The base plate which is preferably made of aluminum, plastic or any other suitable material has a recess 16' provided from underneath. The recess provides an encasing frame 17' in which a slide 18' is displacably mounted. The toe roller 2' is by a vertical shaft 19' mounted in the slide 18'. The roller is rotatable on the said shaft 19' and extends through an elongated bore 20' in which the shaft 19' together with the roller 2' can be moved from the illustrated rear position, which is a stop position, to a position spaced to the left as shown in the drawing which position is taken when the ski boot 4' has been tread into the binding.

The frame 17' has a central inner yoke 21' through a clamp screw 22' extends. The clamp screw 22' is threaded into a spring carrier 23' which on opposite sides of yoke 21' carries a spring pac 24'. The spring 24' preferably is a pac of leaf springs. The spring pacs 24' are kept under tension by a tension wire 25' extending from one spring pack forwardly and in a U-formation through the slide 18', round the shaft 19' of the roller 2' and back to rear end of the other spring pac. The tension wire 25' is over washers 26' fixed mounted at the ends of each spring pac.

By pulling the clamp screw 22' the spring carrier 23' is pulled towards the yoke 21' whereby the spring pacs 24' are tensioned. Thereby different spring tensions for the toe roller 24 may be obtained giving any intended release force.

Just in front of the stepped down portion 6' of the base plate there is a double-conical formed vertical through slot 27' the rear cone portion of which is preferably lined with a plastic lining, for instance a self-lubricating plastic sleeve 28'. In the slot 27' a brake 29' is mounted. The brake 29' is made as an angularly bent bail of some resilient material providing a two-armed lever which is rotatable about a shaft extending sideways through the base plate adjacent the rear end of the rear cone portion of the slot 27'. One lever arm provides two brake arms 31' extending rearwards and/or rearwards-downwards aside of the base plate 1' and of the ski 30'. At the outer ends the brake arms 31' are formed with brake sleeves 32' of some suitable material like plastic. From the arms 21' the bail is bent angularly and extends through material of the base plate in which the bail provides pivot shafts 33 for the brake. The other lever arm provides a forwards and/or forwards-upwards directed clamp 34' of a size which may be received in the front portion of the slot 27'. From the longitudinal center of the brake the pivot shafts 33' extend outwards-rearwards and in addition thereto slightly downwards thereby providing a spring actuation of the brake tending to press the brake to the brake position as shown in FIGS. 1' and 3'. By making the brake slightly prestressed it tends in the non-actuated state to rotate in the clock-wise direction as illustrated in FIG. 3A while sliding along the sides of the plastic sleeve 28'. For folding the brake in or up it is necessary to press down the clamp 34' whereby the branches of the clamp slide towards the narrowest portion of the double conical slot so as to be compressed against the spring action. Such folding of the brake is provided by treading the boot 4' into the binding, whereby the bottom of the boot presses the clamp 34' down and lifts the brake arms 31'.

The base plate 1' with the toe connection means 2', the heel connection means 3' and the brake 29' is mounted slightly spaced above the upper surface 35' of the ski 30' by means of screws 36' and distance sleeves at the rear end of the binding, for instance at or adjacent the pivot shaft 11' of the heel connection means 3'. At the front end the base plate is formed with a pin 37' projecting forwardly and having a ball formed head 38' of a suitable radius. The pin 37' is actually displacable and rotatable in a front side 39' which is screwed directly to the ski 30'. The slide 39' is at the rear end formed a bore 40' having a slide bushing 41' in which the head 38' of the pin is freely displacable. The said mounting of the ski binding makes it possible for the ski 30' to bow both upwards and downwards in relation to the base plate and also to rotate and to achieve what is of importance, that is to have the ski follow the undulations of the hill as well as possible when down hill skiing, especially when using the binding on easily bendable skiis.

Figure 4:
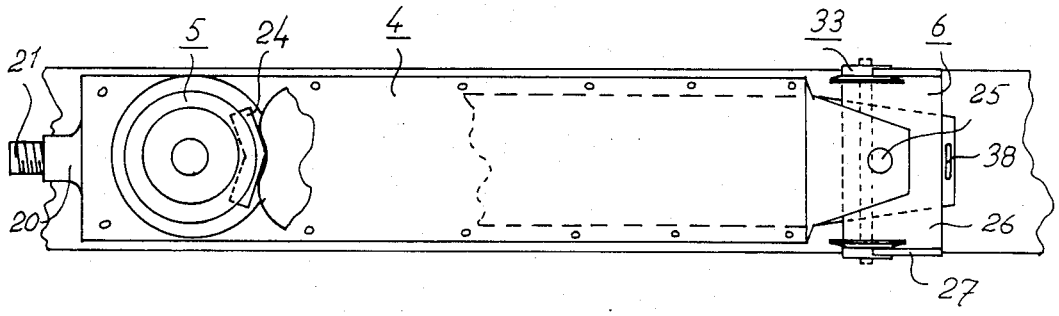
FIG. 4A is a top view of an alternative embodiment of the invention having a slidable connection at the rear end of the binding.
Figure 4A:
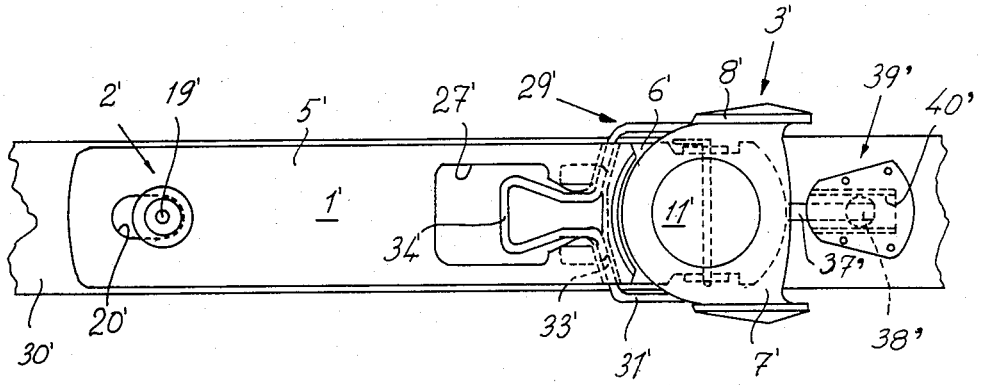
Figure 5A:
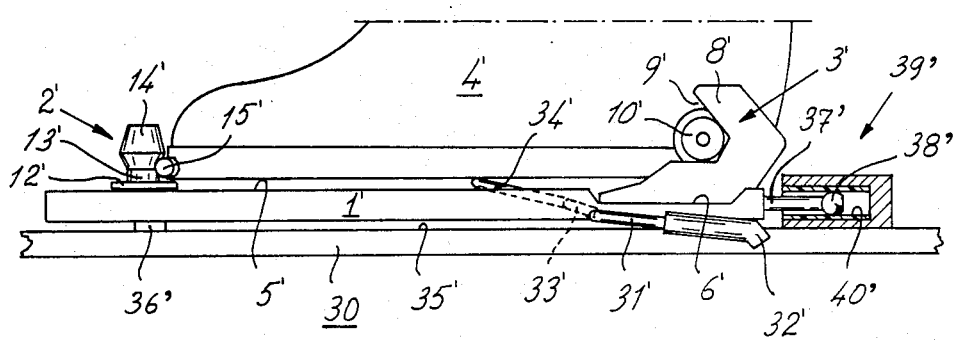
FIG. 5A is a partially cut through side view of the ski binding of FIG. 4A.

In the embodiment of the invention illustrated in FIGS. 4A and 5A the binding is fixedly mounted to the ski by means of a screw joint 36' adjacent the front end of the binding. At the rear end the binding is slidably and rotatably mounted in a slide joint 39' which is screwed to the ski 30' rearwardly of the base plate 1' and which has a bore 40' extending in the longitudinal direction of the ski and which may be lined with a friction reducing sleeve. At the rear end of the base plate 1' a pin 37' projects which at the end is formed with a substantially ball formed head 38' which is slidably and rotatably received in the bore 40' of the slide 39'. The ski 30' is free to bow upwards or downwards underneath the base plate between the front screw joint 36' and the rear slide 39', and the ski also may rotate slightly in relation to the fixed point provided by the front screw joint 36' and the movable point provided by the slide connection means 39'.

Figure 6A:
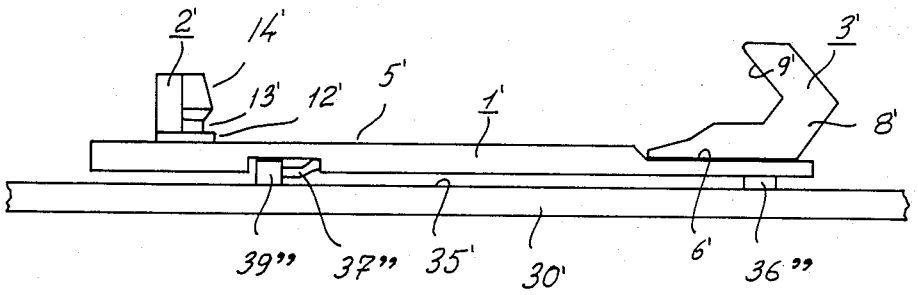
FIG. 6A is a side view of another modified embodiment of the invention.

For some other purposes it may be suitable to have a slidable and rotatable connection means located on a line substantially corresponding to the average line of gravity point of the skier. Such line can be supposed to be located somewhere between a vertical line through the toe connection means 2' and the heel connection means 3'. For such embodiment the slide connection means should be mounted underneath or possibly aside of the binding between the toe connection means 2' and the heel connection means 3'. Such an embodiment is illustrated in FIG. 6A, in which a fixed screw joint 36'' between the base plate 1' and the ski 30' is provided at or adjacent the heel connection means 3', whereas the binding is mounted by means of a slide 39'' at the said average line of gravity. The pin 37'' of the base plate is angularly bent and is slidable and rotatably received in the slide 39''. It is obvious that a relative movement between the slide 39'' and the pin 37'' becomes shorter if the distance between the connection points 36'' and 39'' is made shorter and that the operators may be modified accordingly.

Figure 7A:
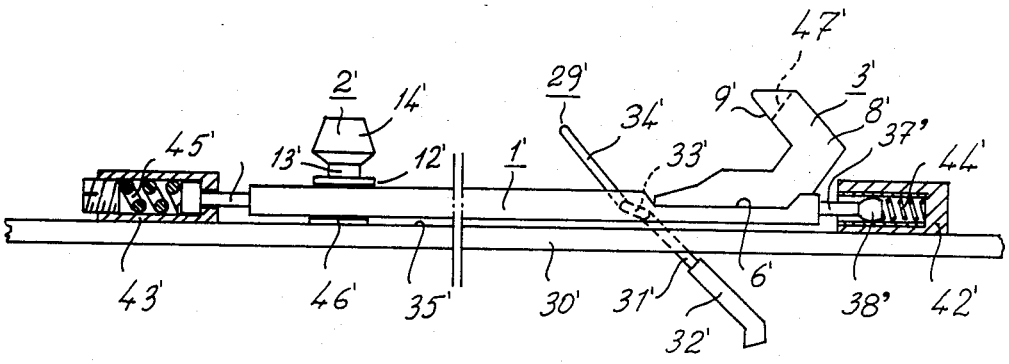
FIG. 7A is a partially cut through side view of a still further embodiment of the invention.

For other purposes it may be suitable to mount the binding slidable and rotatable as a complete unit on the ski. Such an embodiment is illustrated in FIG. 7A. In this case the binding is mounted with a first slide 42' at the rear end thereof as shown in FIGS. 4A and 5A, and somewhere at a forwardly located point the binding is mounted by means of a second slide 43' of substantially the same type as shown in FIGS. 1–3 or FIG. 6. For keeping the binding in the intended position in the longitudinal direction of the ski 30' a spring 44' of the first slide 42' is intended to bias the rear pin 37' forwardly, and correspondingly the front slide 43' has a spring 45' which biases the front pin 37'' rearwardly. Depending on which slide is wanted to give the largest action the springs 44' and 45' are provided differently strong, but normally it can be considered most suitable to form the front spring 45' stronger than the rear spring 44' so that the main movement is provided at the rear portion of the binding.

For preventing unintentional rotation of the base plate 1' in relation to the ski 30' slide buttons 46' can be mounted between the base plate 1' and the ski 30' someplace between the toe connection means and the heel connection means depending on where a rotation of the binding in relation to the ski is wanted. It is also possible to provide the binding so that the main longitudinal displacement of the ski in relation to the binding is received at the rear end of the binding and that the rotation is provided forwardly from the rear end by providing the slide buttons 46' at the rear end of the binding or vice versa.

When using the ski binding according to the invention the ski boot 4' is, with the side connection means 10' thereof, moved into the slots 9' of the side plates 8' whereupon the ski boot with the toe portion is tread down while the concave portion 15' thereof slides along the cone portion 14' of the toe connection means and snaps into the neck portion 13'. This is possible since the toe connection means 4' is resiliently mounted and moves forwardly while treading the boot into the binding until the concave toe portion 15' of the boot snaps over the cone edge to the neck 13'.

If desired treading of the boot into the binding also may be accomplished by firstly putting the toe portion of the boot into the toe connection means 2 and thereafter treading down the heel of the boot, and in this case the side plates 8 are formed with an entering edge 47 as indicated with the dotted lines of FIG. 7.

As mentioned above the ski is capable of moving in the longitudinal direction and to rotate slightly in relation to the binding while skiing, whereby the ski in the best possible way may follow the formation of the hill and adapt itself to the skiing style of the skier.

Release of the binding may follow in several different ways, namely by lifting the heel so that the side rollers 10' slide out of the slot 9' or by rotating the toe portion of the boot so as to slidably twist out of the toe roller 2'. In special embodiment of the toe connection means release may also be accomplished by moving the toe portion of the boot straight upwards. As soon as the binding has released and the boot is removed from the base plate 1' the brake 29 is automatically rotated to its brake position depending on its own spring actuation so that the brake arms 31' prevent movement of the ski downhill away from the skier.

It is to be understood that the above described embodiments of the invention which are illustrated in the drawings are only illuminating examples and that all kinds of modifications may be presented in the scope of the appended claims.

What is claimed is:

1. Safety binding for downhill skiing comprising a toe connection means and a heel connection means for cooperation with corresponding parts of a ski boot, a base plate (4) adapted for attachment to longitudinally spaced locations of a downhill ski, said toe connection means comprising a single biconic roller member (5) having a lower support web portion (16) and from the said web portion an upwardly diverging annular surface portion (17) for engagement by a boot toe, which member (5) is movable in the longitudinal direction of the ski, and biasing means urging said member (5) toward said heel connection means, at least one of said toe and heel connection means provided on said base plate.

2. Safety binding according to claim 1, characterized in that the heel connection means comprises a U-formed clamp (26–27), a fixed pin provided in said plate, said clamp rotatably mounted about said fixed pin (25) of said heel connection means.

3. Safety binding according to claims 1 or 2, characterized in that the toe connection means and the heel connection means are both mounted to said base plate (4), said toe connection means including a vertical pin (12) and a slide (19) supporting said pin, said slide being received in said plate for said movement longitudinally.

4. Safety binding according to claim 1 characterized in that the heel connection means comprises two parallel and upwardly directed lock clamps (27) having recesses facing the front part of the binding, to receive laterally outwardly projecting portions (35) adjacent the heel of the ski boot, each of said clamps (27) having an upper edge (30) of the said recess extending at some angle to the horizontal plane in order to enable a release upwards of the heel part of boot (3), and in that the lock clamp (27) has an entering edge (32) extending upwards-rearwards from the said upper edge (30) in order to enable a treading down of the ski boot heel into the clamps of the heel connection means.

5. Safety binding according to claim 4, characterized in that the boot heel portions that project laterally are provided at a point substantially corresponding to a plane extending through the tibia of the skier, said portions defined by a connection roller (33) on each side of the boot, which rollers coact with the lock clamps (27) to clamp the boot heel into the heel connection means.

6. Safety binding according to claim 1, characterized in that the biconic roller member (5) has a conical upper surface (18) allowing a treading of the boot into the binding from above and wherein said upwardly diverging lower surface (17) also comprises a conical surface (17) allowing a release in the direction upwards of the boot.

7. Safety binding according to claim 6, characterized in that a vertical pin (12) rotatably supports said roller, a slide (19) which is slidable in the longitudinal direction of the ski and which carries said pin, and spring biasing means to urge said slide toward said heel connection means.

8. Safety binding according to claim 7, characterized in that two parallel guide bars (11) are provided in said base plate to slidably receive said slide, and in that the biasing means includes an adjustable screw (21) which is threaded at the front part of the plate and which has a shoulder, and said spring means (23) provided between the shoulder of the screw and the slide (10).

9. Safety binding according to claim 3, characterized in that the base plate (4) is mounted at a slight distance above the ski (2).

10. Safety binding according to claim 3, characterized in that the toe connection means and the heel connection means are formed so that there is a slight space between the under side of the boot (3) and the upper side of the plate (4).

11. A ski binding for a ski boot (3) having portions (35) projecting laterally outwardly adjacent the boot's heel and a concave toe portion (24) said binding comprising a longitudinally extending plate (4) adapted to be permanently attached to a ski (2), toe connection means including a member (5) mounted for limited movement longitudinally of said plate (4), a convexly contoured boot contacting portion (17) of said toe connection means for engaging the boot's concave toe portion (24), a heel connection means including a U-shaped member (6) having upwardly projecting legs (27) with forwardly open recesses (30) for engaging said ski boot projecting portions (35), said U-shaped member (6) pivotally mounted for movement on a vertical axis defined in said plate (4), and means (22) biasing said movable member (5) rearwardly in said plate (4) toward said vertical pivot axis of said U-shaped member (6).

12. The combination defined by claim 11 wherein said member (5) comprises a roller, a vertical shaft (12) for rotatably supporting said roller (5), a slide (12) movably mounted in said plate (4) and supporting said shaft (10) to provide the limited longitudinal movement of said member (5).

13. The combination defined by claim 11 wherein said member (5) has said convexly contoured portion (17) defined by an upwardly diverging conical portion (17) spaced above the upper surface of said plate (4), and said member (5) further including an upwardly converging conical portion (18) above said portion (17).

14. The combination defined by claim 11 wherein said forwardly open recesses (30) are each defined by a forwardly inclined downwardly facing edge (30) spaced above the upper surface of said plate (4), and said recess further including an upwardly and rearwardly inclined edge (32) above said edge (30).

15. The combination defined by claim 14 wherein said member (5) has convexly contoured portion (17) defined by an upwardly diverging conical portion (17) spaced above the upper surface of said plate (4), and said member (5) further including an upwardly converging conical portion (18) above said portion (17).

* * * * *